US006386071B1

(12) United States Patent
McIntyre

(10) Patent No.: US 6,386,071 B1
(45) Date of Patent: May 14, 2002

(54) RECOIL REDUCING APPARATUS FOR STRIKING TOOLS

(75) Inventor: Jonothon M. W. McIntyre, La Crescenta, CA (US)

(73) Assignee: M.O.M. Products, Inc., Palmdale, CA (US)

( * ) Notice: Subject to any disclaimer, the term of this patent is extended or adjusted under 35 U.S.C. 154(b) by 0 days.

(21) Appl. No.: 09/707,652

(22) Filed: Nov. 7, 2000

Related U.S. Application Data

(60) Provisional application No. 60/170,323, filed on Dec. 13, 1999.

(51) Int. Cl.[7] ..... B25D 1/12
(52) U.S. Cl. ..... 81/22; 81/21
(58) Field of Search ..... 81/21, 22, 489

(56) References Cited

U.S. PATENT DOCUMENTS

| | | | | |
|---|---|---|---|---|
| 2,765,827 A | | 10/1956 | Hall | |
| 2,983,297 A | | 5/1961 | Wilson | |
| 3,067,790 A | | 12/1962 | Tucker | |
| 3,125,143 A | | 3/1964 | Wilson | |
| 4,309,019 A | * | 1/1982 | Bloom | 248/610 |
| 4,576,361 A | | 3/1986 | Knight | |
| 4,753,137 A | * | 6/1988 | Kennedy | 81/22 |
| 4,941,232 A | * | 7/1990 | Decker et al. | 16/111 R |
| 4,974,286 A | * | 12/1990 | Stowell et al. | 81/489 X |
| 5,400,736 A | * | 3/1995 | Gold | 116/26 |
| 5,588,343 A | * | 12/1996 | Rust et al. | 81/22 X |
| 6,128,977 A | * | 10/2000 | Gierer et al. | 81/22 |

* cited by examiner

*Primary Examiner*—D. S. Meislin
(74) *Attorney, Agent, or Firm*—Kelly, Bauersfeld Lowry & Kelley, LLP

(57) ABSTRACT

A recoil reducing apparatus that is attachable to a striking tool includes a resilient strap having a first aperture which is configured to accept an extension of the striking tool, and a second aperture spaced from the first aperture along a major axis of the strap and configured to accept a striking portion of the striking tool. The strap also includes a flap which extends from the second aperture. The strap is generally planar and of a resilient elastomeric material, such as urethane rubber. When used with a hammer, an extension of the hammer, such as the claw, is inserted through the first aperture of the strap. The second aperture is pulled over the striking head of the hammer resulting in a tight fit with the hammer head.

10 Claims, 2 Drawing Sheets

RECOIL REDUCING APPARATUS FOR STRIKING TOOLS

RELATED APPLICATION

This application claims priority from provisional application Serial No. 60/170,323 filed Dec. 13, 1999.

BACKGROUND OF THE INVENTION

The present invention relates to striking tools such as hammers, sledges, axes, mattocks and the like. More particularly, the present invention relates to an apparatus which is attachable to a striking tool to reduce recoil when a striking tool is impacted with an object.

There are many tools which are intended for striking objects or surfaces. For example, a golf club is intended to strike a golf ball, a claw hammer is intended to strike a nail, an axe is intended to strike a tree or other wood object, etc. What is common between these striking tools is that there is generated varying degrees of recoil and vibration when the striking tools hits the intended object. The recoil and vibration resulting from the strike causes the tool to lose, in part, its full striking force. Also, the recoil and vibration of the striking tool can cause shock, recoil and pain to parts of the human body in not only direct contact with the striking tool, but also body parts not directly in contact with the striking tool. An example of a claw hammer will be used to illustrate this point.

The hammer is used by gripping the handle, raising the hammer head, and swinging the head toward the nail or other object to be impacted. The hammer head is typically constructed of a relatively heavy and durable material such as steel which can repeatedly and effectively nail, pound or hatch the desired object. However, this action also causes harmful effects such as shock, vibration, and recoil to the human body. The user's posture in taking up the hammer and directing the striking force, when examined in the hand, arm and shoulder area, reveals potential for skeletal, tendon, and muscular injury. When the hammer is in a raised position, the upper arm is in contraction while the lower arm is in extension. This posture remains throughout the downward movement of the hammer's arc. Upon impact, an immediate reversal of the extended and contracted muscles is not allowed due to the immediacy of the action. This leaves the entire skeletal and tendon relationship of the arm exposed to reactive recoil, which can be as great as the amplified striking force. Prolonged and even short term usage of a hammer has proven to be injurious.

In response to the potential for injury, manufacturers began to produce hammers in varying weights, with the objective that the heavier hammers would produce less recoil upon impact. However, the heavier hammer heads have not eliminated injuries and in some cases have led to more serious injuries.

Originally, claw hammer handles were comprised of wood which was wedged into the throat of the hammer. Wood is a desirable handle as it is relatively inexpensive and also acts to somewhat soften the vibration and recoil when the hammer face is struck against an object.

The original curvature and length of the claw produced an effective fulcrum for removing nails, however, it was found that the less expensive and inferior wood handles would split and break off at the steel head joint. Therefore, heavier and more expensive woods were used, as well as synthetic materials such as plastics, fiberglass and metal for the handle. However, synthetic handles sometimes experience more severe vibration and recoil and may be more slippery, particularly after perspiration, and less "grippable" than their wood counterparts. Metal handles also experience severe vibration and recoil and also add to the overall weight of the hammer.

The length and curvature of the claw have also been reduced to prevent breakage of the handle. However, reducing the dimensions of the claw has produced a claw which is not as efficient in nail removal. In fact, the claw curvature of most hammers in use today embody a minimum and nearly ineffectual applied leverage interpretation.

Another problem associated with claw hammers is the marring of the object surface when embedded nails are removed due to the force applied to the hammer in the inverted position as the claw is moved upwardly to remove the nail. While the claw portion of the hammer is moved upwardly from the surface, the poll and face of the hammer are often pushed downward into contact with the surface, causing further damage to the surface. This is particularly a concern with finish carpentry and painted surfaces. A commonly used technique for protecting the surface has been to place a board or other material between the hammer head and the nail bearing surface. However, space constraints may limit the use of this procedure. Moreover, it is not uncommon for the board to slip out from under the hammer head, causing more damage than the removal of the nail without the use of the board.

Accordingly, there is a need for an apparatus which is easily attachable to existing striking tools for reducing the recoil when these instruments are used. There is also a need for an apparatus which reduces the shock and vibration of the striking tool while not impeding the utility of the instrument. In the particular case of the claw hammer, the apparatus should increase the utility of the claw, while preventing damage to finished surfaces. The present invention fulfills these needs and provides other related advantages.

SUMMARY OF THE INVENTION

The present invention resides in a recoil reducing apparatus for striking tools. The apparatus is configured and designed for facile application and removal from a hammer head or other striking tools such as a golf club, pick, mattock, etc., without reducing the effectiveness of the blow of the striking instrument.

The apparatus generally comprises a resiliently flexible strap that is attachable to a striking tool. The strap has a first aperture which is configured to accept an extension of the striking tool. A second aperture is spaced from the first aperture along a major axis of the strap and is configured to accept a striking portion of the striking tool. The strap is comprised of an elastomeric material, such as urethane rubber. The strap is generally planar, with the exception of optional grips which are raised from a surface of the strap. The strap also includes a flap which extends from the second aperture.

Although the apparatus is intended to be used on a variety of striking tools, and can be modified to accommodate such, it is particularly suited for use with hammers wherein the first aperture of the strap is configured to accept an extension of the hammer. Such extensions can include the handle of the hammer or a claw opposite the head of the hammer. The second aperture is configured to accept the striking head of the hammer.

The apparatus acts as a damper to reduce the shock and vibration, and thus injury, caused by repeated striking of objects. The apparatus provides this benefit without impairing the utility of the striking tool.

Other features and advantages of the present invention will become apparent from the following more detailed description, taken in conjunction with the accompanying drawings which illustrate, by way of example, the principles of the invention.

BRIEF DESCRIPTION OF THE DRAWINGS

The accompanying drawings illustrate the invention. In such drawings.

DETAILED DESCRIPTION OF THE PREFERRED EMBODIMENT

Figure 1:
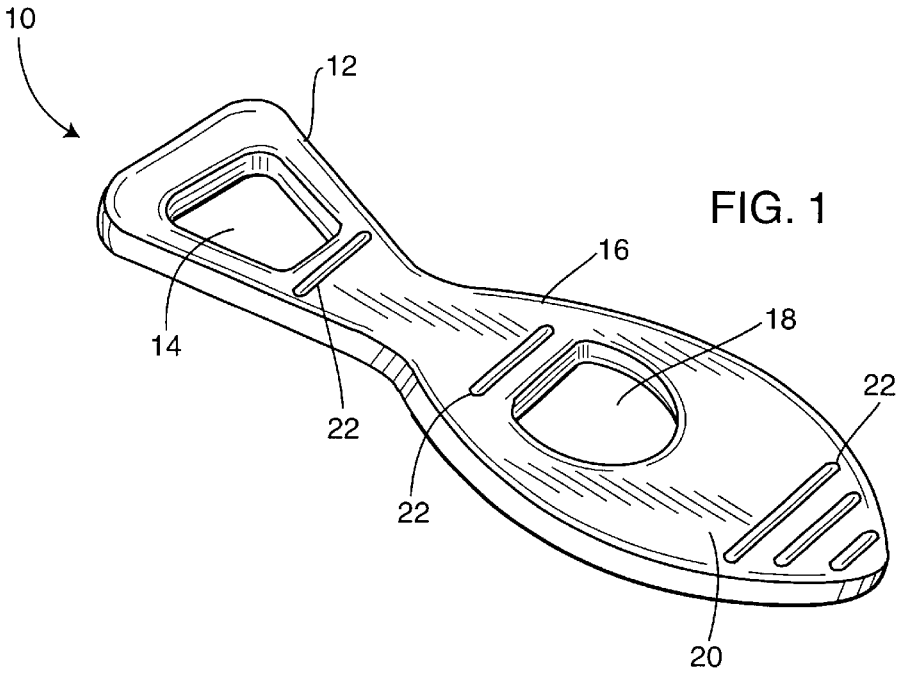
FIG. 1 is a perspective view of a recoil reducing apparatus embodying the present invention.

As shown in the drawings for purposes of illustration, the present invention is concerned with a recoil reducing apparatus in the form of a strap 10 which is wrapped about or otherwise attached to a striking tool and which acts to absorb shock from the striking tool when it impacts an object.

The strap 10 is comprised of a resilient elastomer. Urethane rubber has been found to be most effective as it is malleable yet sufficiently durable to withstand striking mishits which result in the object striking the surface of the strap 10 instead of the intended striking surface.

Figure 2:
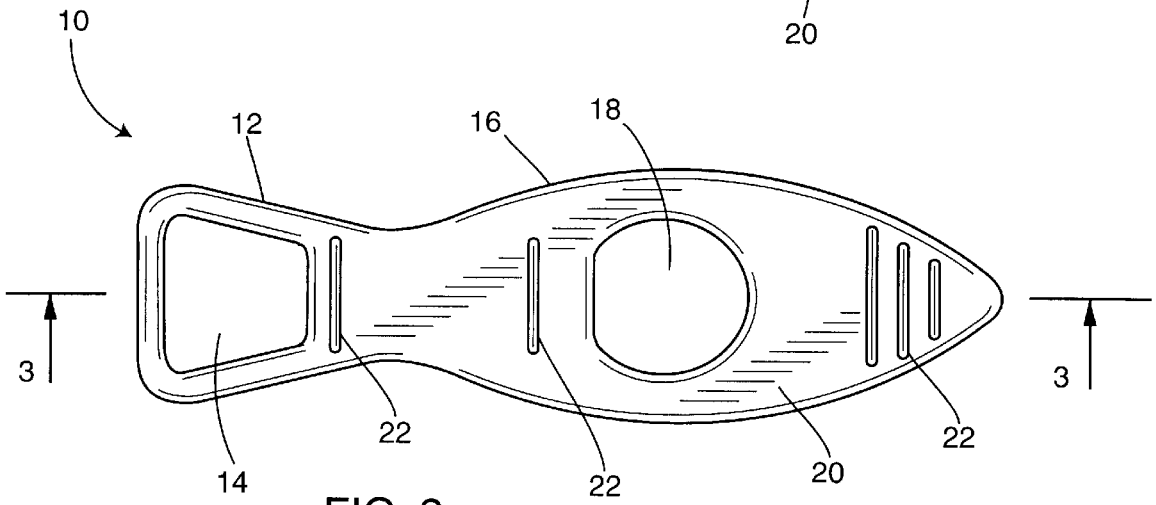
FIG. 2 is a top plan view of the apparatus of FIG. 1.
Figure 3:
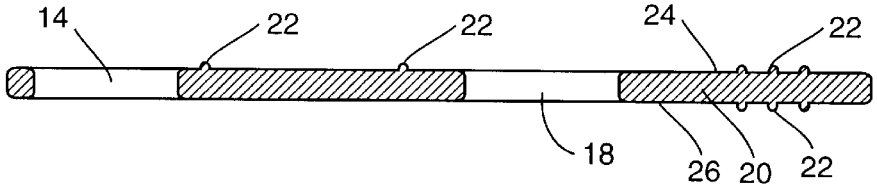
FIG. 3 is a cross-sectional view of the apparatus taken generally along line 3—3 of FIG. 2.

Referring to FIGS. 1–3, in its relaxed state the attachment strap 10 is generally planar and somewhat elongated. The strap 10 includes a rear area 12 having a first aperture 14 therethrough. A front area 16 of the strap 10 has a second aperture 18 which is spaced from the first aperture 14 along a major axis of the strap 10. In the illustrated preferred embodiment, a flap 20 extends from the second aperture 18.

Raised grips 22 extend from a top 24 surface of the strap 10 near the first and second apertures 14 and 18. There are also raised grips 22 extending from the top and bottom surfaces 24 and 26 of the flap 20, as illustrated in FIG. 3. These grips 22 facilitate the placement of the strap 10 on the striking tool as the rubber-like material comprising the strap 10 may sometimes become somewhat slippery when wet or grasped by perspiring fingers.

Although a claw hammer 28 is illustrated and described for exemplary purposes as a preferred embodiment, it is to be understood that the invention may be modified as necessary to be adaptable to other striking instruments and devices such as, but not limited to, golf clubs, picks, axes, and mattocks.

A claw hammer 28 typically has a metal head 30 comprised of a front striking area called a face 32, a poll area 34 directly behind the face 32, a neck 36 defining a throat 38 through which a handle 40 is inserted, and a claw 42 generally opposite the sledge or hammer head face 32 which acts as a crow-bar like lever having a V-shaped slot 44 for removal of nails 46 and other fasteners.

Figure 4:
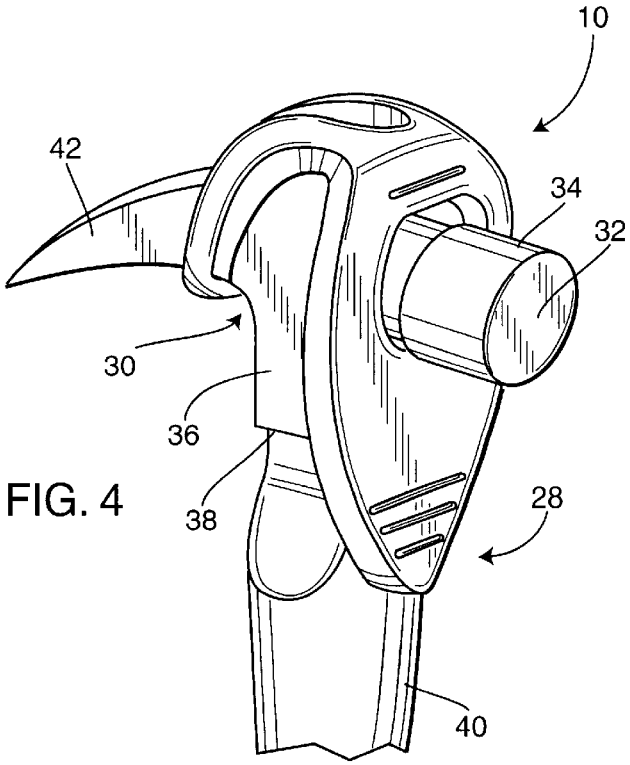
FIG. 4 is a perspective view of a hammer head having the recoil reducing apparatus of FIGS. 1–3 attached thereto.
Figure 5:
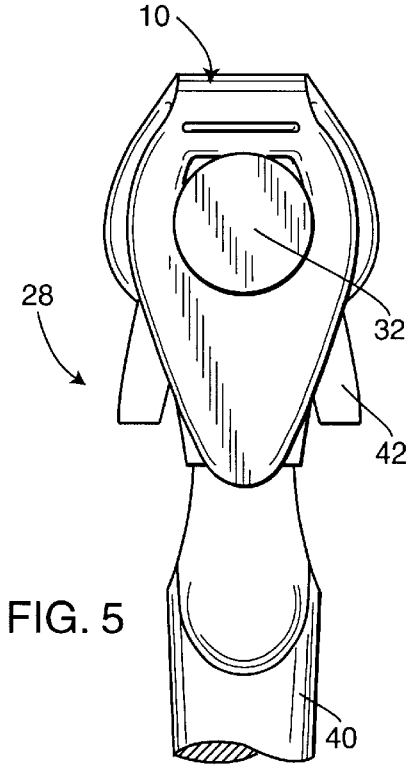
FIG. 5 is a front elevational view of the hammer head and attached apparatus of FIG. 4.
Figure 6:
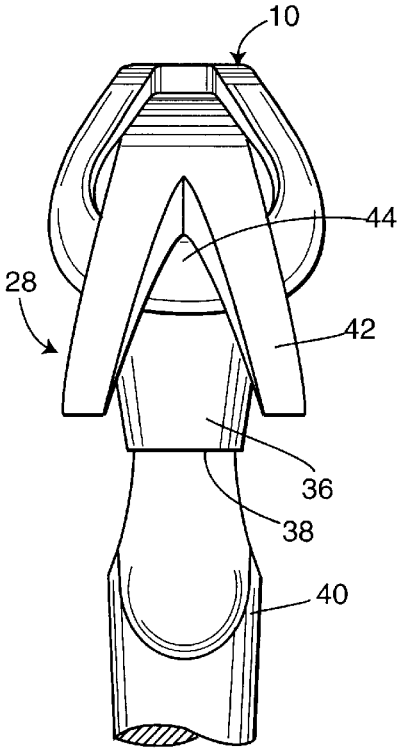
FIG. 6 is a rear elevational view of the hammer head and attached apparatus of FIG. 4.

As illustrated in FIGS. 4–6, the strap 10 is wrapped around the hammer head 30 by inserting the face 32 of the hammer 28 through the second aperture 18 so that the flap 20 underlies the face 32. The rear area 12 is then stretched back until the first aperture 12 fits over the claw 42. The attachment strap 10 is sized such that a tight fit is formed between the strap 10 and the hammer head 30.

The flap 20 underlies the face 32 and poll 34 so as to cover the neck 36 and also the top portion of the handle 40. The flap 20 is believed to further reduce the recoil and vibration of the hammer as it moves and vibrates independently of the hammer upon impact, dissipating the vibrations which would otherwise travel through the hammer handle 40 and into the hand and arm of the user. The flap 20 also protects the neck 36 and covered portion of the handle 40 during mishits. Such mishits without the strap 10 in place can damage the hammer head 30 and even split the handle 40 in the case of extreme mishits. Mishits without the strap 10 attached can also cause more severe and violent recoil and vibration than usual.

The association of the strap 10 with the hammer 28 acts to absorb and dampen not only the mishits, but also direct hits to the object. With the attachment strap 10 in place, the user will notice a "sweet-spot" on the face 32 of the hammer head 30. When the user hits the object on or near the sweetspot, vibration is minimal and the force applied to the object is at a maximum. The lessening of vibration and recoil of the hammer translates into less shock and recoil experienced in the palm, wrist, elbow, arm and shoulder of the user. Therefore, use of the present invention reduces the possibility of injuries due to both short term and prolonged use of the hammer 28.

Figure 7:
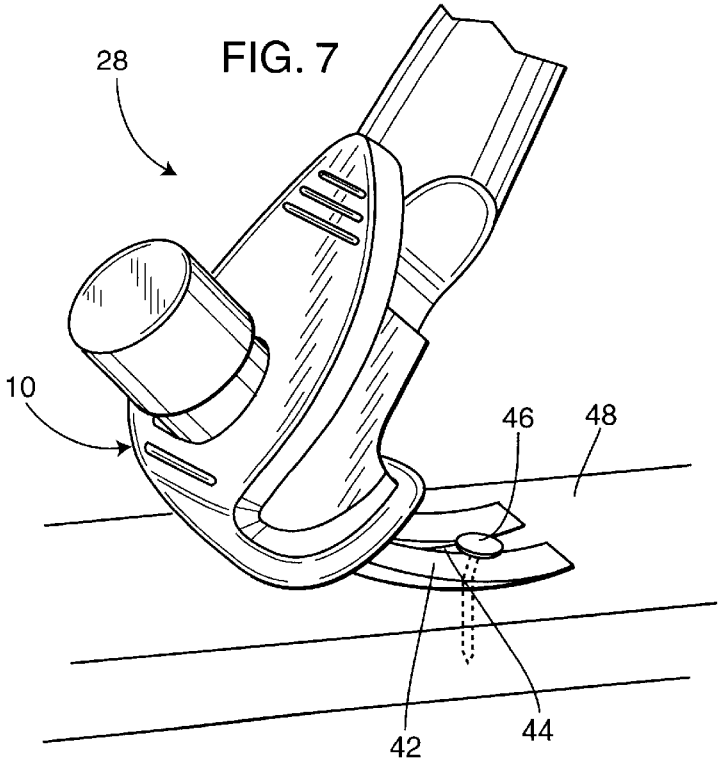
FIG. 7 is a perspective view of the hammer head and attached apparatus of FIGS. 4–6, illustrating use of the apparatus in the removal of an embedded nail.

As illustrated in FIG. 7, another aspect of the strap 10 is the increase in fulcrum provided the claw 42 while removing an embedded nail 46 from an object 48. Existing claws typically pull the nail 46 at an angle from vertical, which causes the exiting nail 46 to form a greater hole in the object than it originally formed. The height extension realized by the attachment of the strap 10 not only provides increased leverage, but also pulls the nail 46 out at a more upward angle so that the original hole in the surface or object 48 is not as greatly enlarged.

The elastomeric nature of the strap 10 also provides a cushion between the hard, usually metallic, hammer head 30 and the object 48, preventing marring and other damage to the surface of the object 48. Also, the design of the strap 10 acts to prevent the poll 34 and face 32 of the hammer 28 from being pushed into and damage the surface of the object 48.

The strap 10 creates an elevated fulcrum point which is optimally positioned to extract the nail 34 with less force. Also, the elastomeric material comprising the strap 10 aids in the removal of embedded nails 46. The characteristics of the synthetic urethane resin composition of the strap 10 upon compression begin to store an ever increasing potential energy source. Material capable of molecularly storing energy under compression delivers a multiplied and increased factor of relative expansive stored energy. The stored potential energy source aids in the extraction of the nail 46. At the moment the stored energy source becomes greater than the resistance present in the nail 46 secured and held by friction within the object 48, the compression factor inverts and becomes an available applied energy source and facilitating ease of removal of the nail 46.

The attachment strap 10 is producible in a variety of colors. Aside from the cosmetic appearance of the striking tool, it is known in the art that higher visibility of the striking tool produces greater optical certainty when directing the use of the tool. For example, the user will be able to better see the hammer head 30 and direct the striking face 32 more accurately onto the nail during the downward swing. The colors can also be used to quickly locate misplaced hammers, or identify various hammers by weight or style.

While the present invention has been illustrated and described in use on a claw hammer 28 for exemplary purposes, it is to be understood that the invention is not limited to such. There are approximately six popular carpentry hammer models, perhaps ten models in metal and welding, and about five hammer models in the masonry field. The invention can be adapted as necessary to accommodate these and different styled hammer heads. For example, the strap 10 can include a third aperture for use with a sledge hammer wherein the handle of the hammer is inserted through a central aperture and the opposing striking surfaces of the hammer are inserted through the outer apertures. Of course, the primary embodiment described above may be modified for use with a sledge hammer in the same manner as used with the illustrated claw hammer. The strap 10 can be configured to accommodate various other non-hammer striking instruments and devices. For example, the apertures 12 and 18 of the strap 10 can be elongated, enlarged or reduced in size to accommodate the head of an axe or hatchet. Regardless of the type of hammer or other striking tool the strap 10 is attached to, the reduction of recoil and vibration benefits described above are achieved.

Although an embodiment has been described in detail for purposes of illustration, various modifications may be made without departing from the scope and spirit of the invention. Accordingly, the invention is not to be limited, except as by the appended claims.

What is claimed is:

1. A reduced recoil striking tool, comprising:

a hammer having a head and an extension therefrom; and a resilient strap removably attachable to the hammer and having a first aperture which is configured to accept the extension of the hammer, and a second aperture spaced from the first aperture along a major axis of the strap and configured to accept the head of the hammer therethrough, and an elongated flap which extends from the second aperture.

2. The striking tool of claim 1, wherein the hammer extension comprises a handle which is insertable into the first aperture.

3. The apparatus of claim wherein the hammer extension comprises a claw generally opposite the head and insertable into the first aperture.

4. The apparatus of claim 1, wherein the strap is comprised of a resiliently elastomeric material.

5. The apparatus of claim 4, wherein the elastomeric material is urethane rubber.

6. The apparatus of claim 1, wherein the strap is generally planar in an unflexed condition.

7. The apparatus of claim 7, wherein the strap includes grips raised from a surface thereof for assisting in the attachment of the strap onto the striking tool.

8. A reduced recoil striking tool, comprising:

a hammer having a head, a claw and a handle extending therefrom; and a resilient strap comprised of an elastomeric material and being generally planar in an unflexed position, the strap having a first aperture which is configured to accept the claw of the hammer, a second aperture spaced from the first aperture along a major axis of the strap and configured to accept the head of the hammer therethrough, and an elongated flap extending from the second aperture and towards the handle of the hammer.

9. The apparatus of claim 8, wherein the elastomeric material is urethane rubber.

10. The apparatus of claim 8, wherein the strap includes grips raised from a surface thereof for assisting in the attachment of the strap onto the striking tool.

* * * * *